United States Patent [19]

Dale et al.

[11] 4,195,438

[45] Apr. 1, 1980

[54] ORNITHOPTER CONSTRUCTION

[76] Inventors: Frank L. Dale; Leitzel S. Dale, both of 948 Oakhill Dr. NE., Massillon, Ohio 44646

[21] Appl. No.: 945,838

[22] Filed: Sep. 26, 1978

[51] Int. Cl.[2] ..... A63H 27/00

[52] U.S. Cl. ..... 46/74 R

[58] Field of Search ..... 46/76 R, 74 R; 244/22

[56] References Cited

U.S. PATENT DOCUMENTS

| | | | |
|---|---|---|---|
| 1,758,178 | 5/1930 | Slinn | 46/74 R |
| 2,321,977 | 6/1943 | Boatright | 46/74 R |
| 2,504,567 | 4/1950 | Morgan | 46/74 R |
| 2,814,907 | 4/1956 | Sears | 46/74 R |
| 2,859,533 | 11/1958 | Spencer | 46/74 R |
| 3,626,555 | 12/1971 | Albertini et al. | 46/74 R |
| 3,728,814 | 4/1973 | Ruston | 46/74 R |

FOREIGN PATENT DOCUMENTS

| | | | |
|---|---|---|---|
| 2755786 | 6/1978 | Fed. Rep. of Germany | 46/74 R |

*Primary Examiner*—F. Barry Shay

*Attorney, Agent, or Firm*—Frease & Bishop

[57] ABSTRACT

An ornithopter having a pair of flexible fabric wings which are flapped in unison by an elastic motor-operated crank assembly to support the ornithopter during flight. A flexible generally U-shaped member is mounted on the front end of a longitudinal rigid base. A pair of rigid wing struts are pivotally mounted on the tips of the U-shaped member and extend outwardly transversely with respect to the longitudinal base. The crank assembly has a reciprocating lever which is pivotally connected to the inner ends of the wing struts between the spaced tips of the U-shaped member. Rotation of the crank by the elastic motor reciprocates the lever up and down pivoting the wing struts on the tips of the U-shaped member which simultaneously flex inwardly and outwardly, enabling the wings to flap in unison. A flexible spline extends upwardly forwardly from the rear end of the base. A flexible fabric is attached to the wing struts and spline and extends toward the rear of the base to form the pair of wings. The spline is biased downwardly toward the base by the fabric to assist the flapping motion of the wings and to raise the wings to a gliding position after exhaustion of the elastic motor. A tail section may be pivotally mounted on the rear end of the base to adjust the flight characteristics of the ornithopter.

15 Claims, 11 Drawing Figures

ORNITHOPTER CONSTRUCTION

BACKGROUND OF THE INVENTION

1. Field of the Invention

The invention relates to toy aircrafts and particularly to aircraft which are propelled through the air by flapping of the wings, known as ornithopters. More particularly, the invention relates to an ornithopter construction having a flexible, generally U-shaped member on which the wing struts are pivotally mounted to enable the wings to flap in unison.

2. Description of the Prior Art

Various types of heavier-than-air aircraft have been devised which use the flapping motion of a pair or pairs of wings for supporting and moving the aircraft through the air. These types of aircraft are known as ornithopters and have been used extensively for toys and novelty items. Nearly all of these ornithopter constructions are powered by a twisted rubber band which is connected to a crank for tensioning the rubber band prior to flight. The crank is connected to a lever assembly which is connected to a pair of wings which are pivotally mounted on the aircraft frame or lever assembly. Release of the crank enables the twisted rubber band to unwind, rotating the crank and attached lever assembly. The lever assembly will oscillate or move reciprocally in some manner, imparting the flapping motion to the wings for supporting the aircraft. Numerous types of lever and crank assemblies have been devised in an attempt to provide the most efficient and simple motion to move the wings of the ornithopters. Examples of these constructions are shown in U.S. Pat. Nos. 1,758,178, 2,321,977, 2,504,567, 2,814,907, 2,859,553, 3,626,555 and 3,728,814.

Problems occur in many of the types of ornithopters or toys shown in the above-mentioned patents in that it is difficult to flap the wings in unison; that is, each wing of the wing pair should move upwardly and downwardly at the same times as the other. In order to achieve such symmetrical wing movement, an elaborate lever mechanism is required, such as shown in U.S. Pat. No. 3,626,555, which uses a pair of crankshafts or levers. In other known ornithopter constructions, the wings do not flap simultaneously or in unison but somewhere in between an alternate flapping motion and the desired simultaneous flapping motion. This unsymmetrical wing movement results in an erratic and relatively short flight pattern. Likewise, the various crank and lever mechanisms used have a considerable number of moving parts which adds to the weight of the aircraft, increases friction, provides maintenance problems, and has a tendency to "bind up," resulting in unsatisfactory operation.

Accordingly, the need has existed for an improved ornithopter construction which enables a simultaneous flapping wing motion to be obtained with a relatively small number of lightweight moving parts. No known ornithopter construction of which we are aware achieves these objectives by pivotally mounting the wing struts on the upper ends of a flexible, generally U-shaped member.

SUMMARY OF THE INVENTION

Objectives of the invention include providing an ornithopter construction which provides a symmetrical flapping motion to the wings to enable a smooth and sustained flight pattern to be achieved with a relatively small number of moving parts, and in which one of the main features is a generally U-shaped flexible member mounted on or formed as a part of the aircraft frame; providing such an ornithopter construction requiring only a single straight rigid lever extending between the crank of an elastic-powered motor and the intersection of the inner ends of the wing struts, which struts are pivotally mounted on the upper ends of the U-shaped flexible member; providing such an ornithopter construction having a separate tail section which may be pivotally mounted on the rear end of the main aircraft frame to permit the tail angle to be adjusted to control the angle of flight of the aircraft; providing such an ornithopter construction having a flexible spline or backbone rib which is mounted on the rear of the aircraft frame and projects upwardly forwardly therefrom and is spaced above the longitudinal aircraft base, in which a flexible fabric is mounted on and extends between the wing struts and flexible spline and terminates adjacent the base of the spline and aircraft frame to form the supporting wings for the aircraft, and in which the fabric biases the flexible spline downwardly toward the aircraft base whereby the spline overcomes the bias of the fabric to maintain the wings in a slightly raised position after the elastic band is exhausted to enable the aircraft to glide for a considerable distance and period of time; providing such an ornithopter construction in which the top ends of the U-shaped flexible members move generally horizontally inwardly and outwardly during the flapping motion of the aircraft wings, enabling the wings to move symetrically by means of a single crank and connecting lever heretofore not possible with known ornithopter constructions; and providing an ornithopter construction which is extremely simple and inexpensive to construct, which is relatively lightweight, which is sturdy and durable in use, which eliminates difficulties heretofore encountered, achieves the objectives indicated, and solves problems and satisfies needs existing in the art.

These objectives and advantages are obtained by the ornithopter construction, the general nature of which may be stated as including a longitudinally extending base having front and rear ends; a flexible spline mounted on the base adjacent the rear end thereof and projecting upwardly forwardly toward the front end of the base and spaced generally vertically above said base; a generally U-shaped flexible member having a pair of upstanding spaced legs mounted on the front end of the base; a pair of wing struts extending transversely outwardly from adjacent the front end of the base, each of said struts having inner and outer ends; crank means rotatably mounted on the front end of the base; elastic motor means connected to the crank means for rotating said crank means; lever means operatively connected at one end to the crank means for generally reciprocating up and down movement upon rotation of said crank means, with another end of the lever means being operatively connected to the inner ends of the wing struts; flexible fabric means mounted on the wing struts and spline and extending generally between the front and rear ends of the base to form a pair of wings; and the wing struts being pivotally mounted on the upstanding legs of the U-shaped flexible member adjacent the inner ends of the wing struts, whereby reciprocating motion of the lever means upon rotation of the crank means by the elastic motor means pivots the wing struts on the legs providing a flapping motion to the wings simultaneously with an inward and outward flexing motion of the U-shaped member legs.

BRIEF DESCRIPTION OF THE DRAWINGS

Preferred embodiments of the invention—illustrative of the best modes in which applicants have contemplated applying the principles—are set forth in the following description and shown in the drawings and are particularly and distinctly pointed out and set forth in the appended claims.

Similar numerals refer to similar parts throughout the drawings.

DESCRIPTION OF THE PREFERRED EMBODIMENTS

First Embodiment

Figure 1:
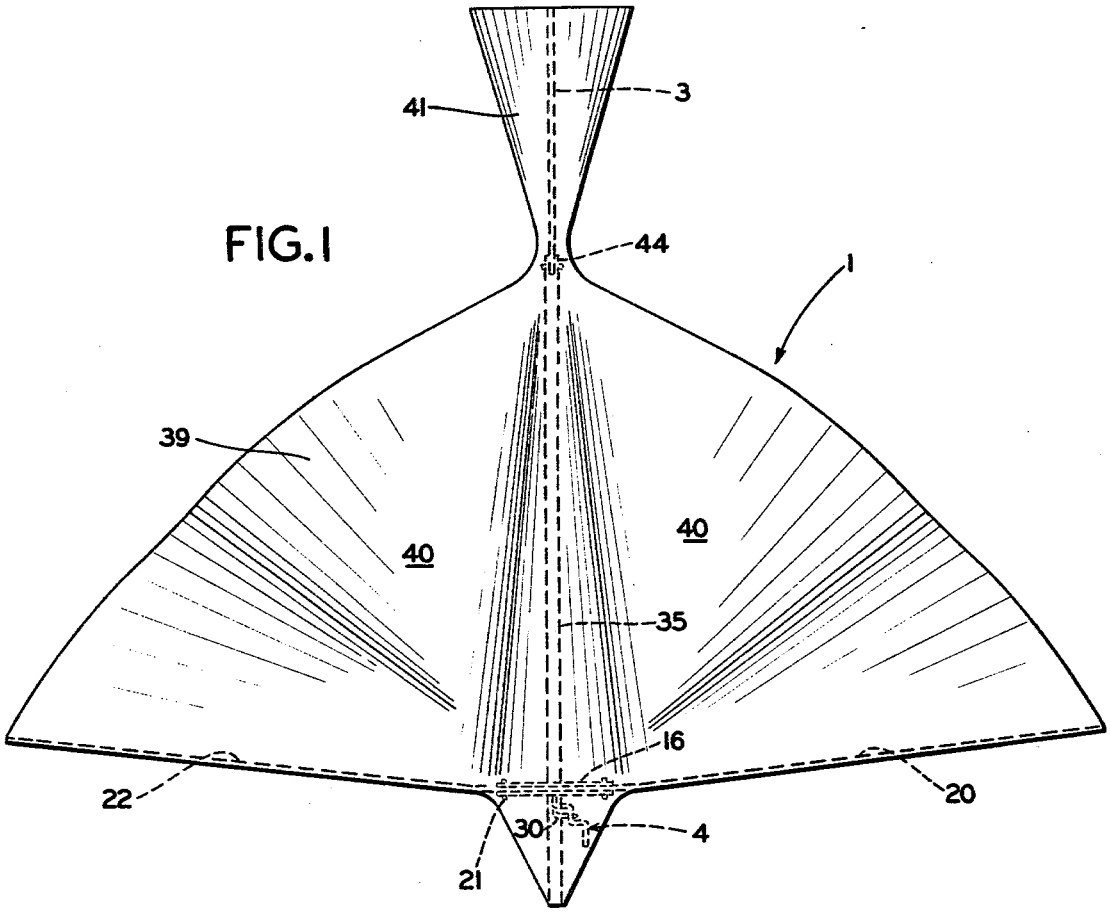
FIG. 1 is a somewhat diagrammatic top plan view of the improved ornithopter construction.
Figure 2:
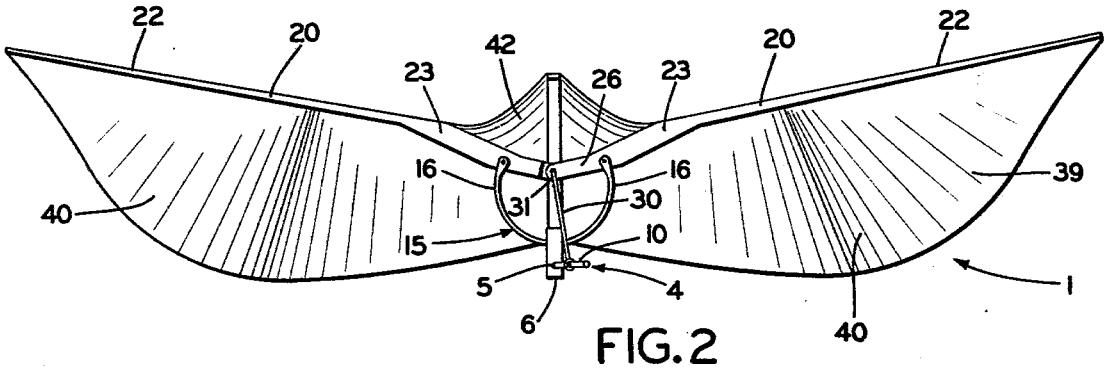
FIG. 2 is a front elevational view of the ornithopter construction shown in FIG. 1.
Figure 3:
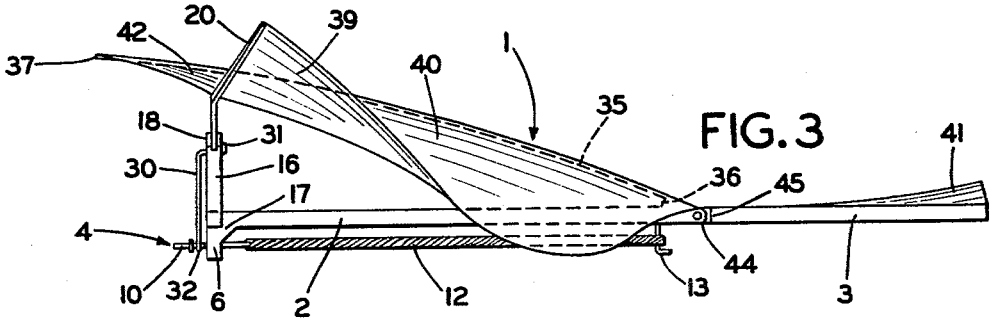
FIG. 3 is a right hand side elevational view of the ornithopter construction shown in FIGS. 1 and 2.
Figure 4:
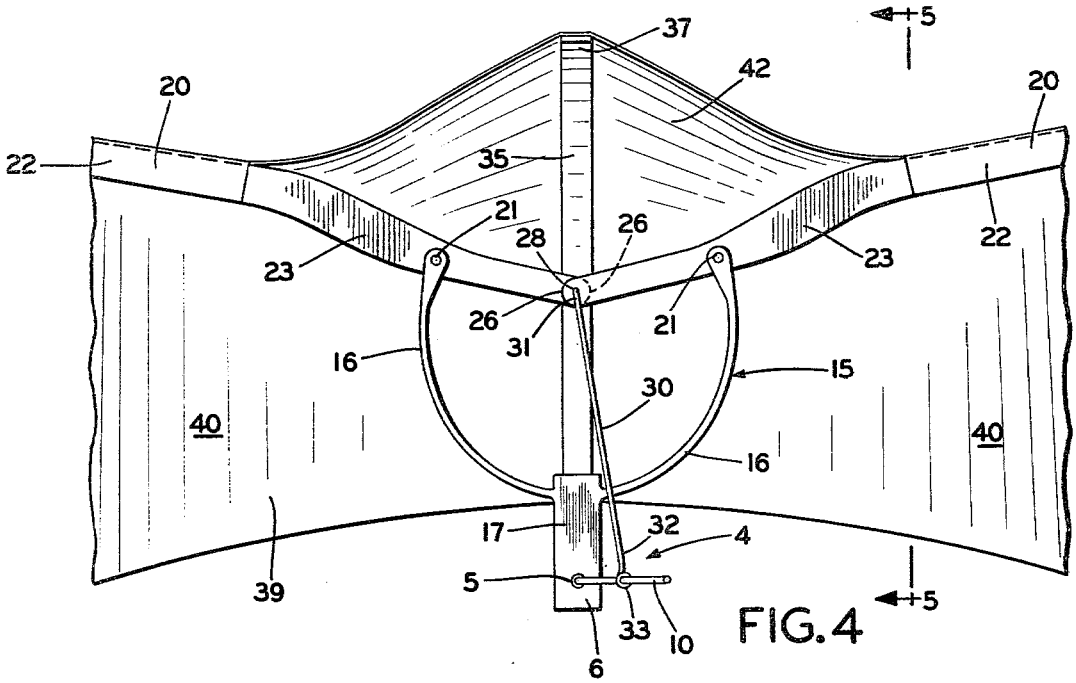
FIG. 4 is an enlarged fragmentary front plan view showing the flexible U-shaped member and associated crank lever assembly.
Figure 5:
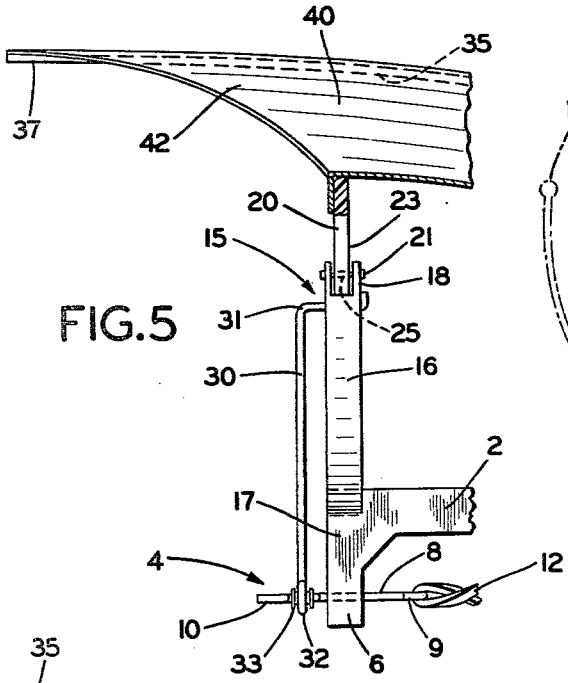
FIG. 5 is a fragmentary sectional view taken on line 5—5, FIG. 4.

The improved ornithopter construction is indicated generally at 1, and is shown in completely assembled condition in FIGS. 1-3. Ornithopter 1 includes a longitudinally extending rigid base 2 having a tail section 3 mounted on the rear end thereof. A crank assembly is indicated generally at 4, and is rotatably mounted on the front end of base 2, preferably extending through an opening 5 formed in the lower portion of a downwardly projecting vertical post 6 (FIGS. 4 and 5).

Crank 4 may be an integral member formed of a stiff piece of wire or similar material. Crank 4 includes an intermediate horizontal section 8 which is rotatably mounted within post opening 5, and terminates in a hook-shaped rear section 9 and an offset, Z-shaped, hand-operated crank front section 10.

An elastic band such as a usual rubber band 12, extends beneath and along base 2 and is connected to hook-shaped rear section 9 of crank 4 and to a downwardly extending pin 13 embedded in the bottom surface of base 2 adjacent tail section 3.

In accordance with the invention, a generally U-shaped flexible member 15 is mounted on or is formed as an integral portion of the front end of base 2 and projects upwardly therefrom. Member 15 is formed by a pair of outwardly bowed or curved arms 16 which may be formed integrally with a trunk 17. Trunk 17, in turn, is mounted on the top of base post 6 or formed integrally with base 2. The upper ends of arms 16 preferably are formed with a clevis configuration 18 (FIG. 5).

A pair of rigid wing struts 20 are pivotally mounted within clevises 18 by pins 21 and extend outwardly from flexible member 15 transversely with respect to base 2. Each wing strut 20 preferably has a straight main section 22 which terminates in an angled downwardly extending inner end section 23.

Pivot pins 21 extend through holes 25 formed in wing strut inner end sections 23 to pivotally mount struts 20 on flexible member 15. The innermost ends 26 of wing struts 20 lie in overlapping relationship with respect to each other and are formed with aligned holes 28 (FIG. 4).

A lever 30 is operatively connected to and extends between front section 10 of crank assembly 4 and innermost ends 26 of wing struts 20. The upper end 31 of lever 30 extends through aligned holes 28, pivotally mounting inner strut ends 26 with respect to lever 30. The lower end 32 of lever 30 may be formed with an annular tip through which section 10 of crank assembly 4 extends to permit crank end 10 to rotate with respect to lever 30. A sleeve bushing 33 may be mounted on crank end 10 and telescopically engaged within lever end 32 to facilitate the sliding rotational movement between the crank and lever during winding and unwinding of crank 4 and rubber band 12.

Figure 6:
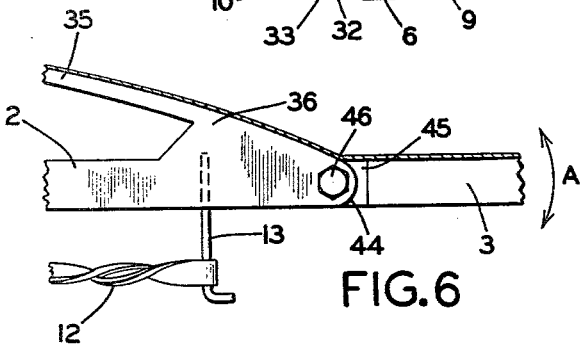
FIG. 6 is an enlarged fragmentary view showing the tail section pivotally mounted on the base of the ornithopter.

In further accordance with the invention, a flexible spline or rib 35 is mounted at 36 on the rear end of base 2, preferably adjacent the junction with tail section 3 (FIG. 6). Spline 35 projects forwardly upwardly from base 2 and extends along base 2 terminating in a front tip 37. Spline 35 extends forwardly beyond the forward end of base 2 and beyond flexible member 15, as shown in FIGS. 3 and 5. A flexible piece of fabric 39 is mounted on and extends between wing struts 20, spline 35, the rear portion of base 2, and tail section 3, to form a pair of wings 40 and a tail 41. Wings 40 are joined together by a domeshaped fabric zone 42 formed by the upwardly biasing effect of spline 35. Zone 42 is integral with wings 40, which together with tail 41 may be a single piece of lightweight cloth fabric 39 or similar material.

Fabric 39 is installed on wing struts 20, spline 35 and tail section 3 in such a manner whereby spline 35 is biased downwardly toward base 2. The biasing action of spline 35 on fabric 39 will automatically pivot wing struts 20 to a partially raised position as shown in FIGS. 2 and 3 when the wings are at rest. This partially raised position of struts 20 imparts a desired configuration to the fabric of wings 40, which places the wings in a glide position. Thus, after exhaustion of the tension of rubber band 12, spline 35 will place wings 40 in such a position enabling sufficient air to be trapped beneath the wings whereby the ornithopter will glide over a greater distance and for a greater duration of time than would be possible if the wings came to rest in a downwardly extending or fully raised position.

Figure 7:
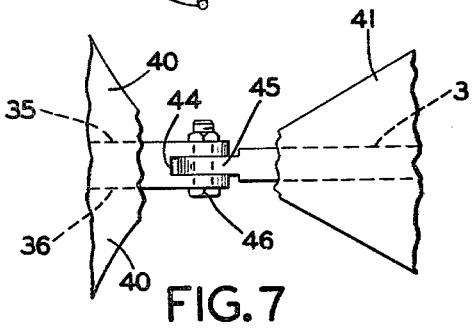
FIG. 7 is a fragmentary top plan with portions broken away of the pivotally mounted tail section of FIG. 6.

Another feature of the invention is the adjustable mounting of tail section 3 on base 2, shown particularly in FIGS. 6 and 7. The rearmost end portion of base 2 is formed with a clevis arrangement 44 into which a reduced end 45 of tail section 3 is pivotally mounted by a clamping pivot bolt 46. Temporary loosening of the clamping action of bolt 46 enables tail section 3 to be moved upwardly or downwardly in the direction of arrows A (FIG. 6), positioning tail 41 at a selected angle with respect to wings 40 and base 2. The particular selected angle of tail 41 with respect to the remaining portion of the ornithopter determines the angle of flight, that is, the position of inclination which base 2 will assume during flight. This adjustment enables various flight characteristics to be achieved. Even though fabric 39 may be a single piece for forming wings 40 and tail 41, it will possess sufficient slack and flexibility to permit sufficient adjustment of tail section 3 and tail 41.

The various structural components of ornithopter 1, such as base 2, wing struts 20, U-shaped member 15, post 6, etc., preferably are formed of a lightweight material such as balsa wood or may be formed as several integral plastic components by various molding procedures. It is also understood that rubber band 12 which provides the motive force for the ornithopter can be replaced by a small gasoline-driven engine of the type used for various small model aircraft to increase the flying time and distance thereof.

Figure 8:
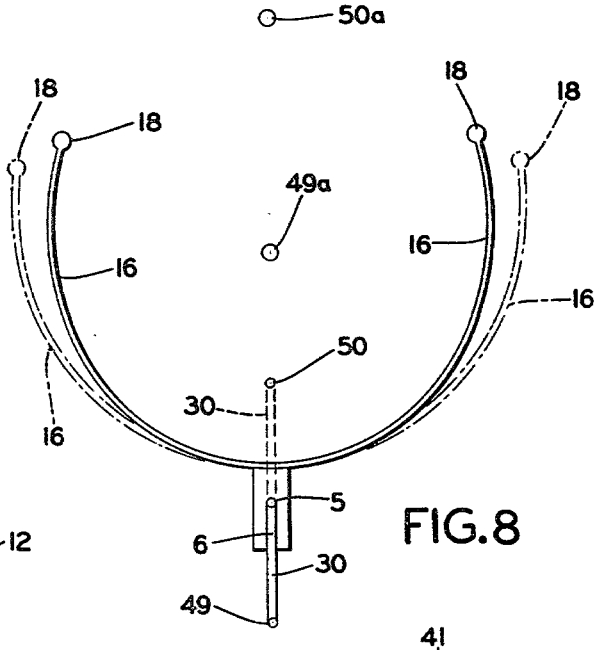
FIG. 8 is a diagrammatic view showing the general movements of the flexible U-shaped frame member and crank assembly during flapping of the aircraft wings.

FIG. 8 shows diagrammatically the flying movement of arms 16 of member 15, which provide the desired operation of the ornithopter, enabling wings 40 to move in unison. Points 49 and 50 represent the two extreme positions of crank end section 10 when rotated by rubber band 12. Points **49*a* and 50*a* show the corresponding positions of lever end 31 and wing strut ends 28 with respect to crank end 10. The full-line positions of arms 16 indicate the location of the arms when crank section 10 and lever end 31 are in positions 49 and 49*a*, respectively. The dot-dash line positions of arms 16 indicate the location of the arms when crank section 10 and lever end 31 are in the positions of 50 and 50*a***, respectively.

Thus, the inner ends 28 of wing struts 20 will oscillate vertically upwardly and downwardly when moved by lever 30 correspondingly with the generally horizontally inwardly and outwardly movement of arms 16. It is this flexing of arms 16 which, in turn, provides the pivotal mounting for the wing struts that eliminates the heretofore elaborate crank and lever assemblies required with prior ornithopter constructions in an attempt to achieve symmetrical and uniform wing movement.

Flexible member 15 may have other configurations than that shown in FIGS. 1–6 in order to achieve the desired results without departing from the concept of the invention. For example, arms 16 may form a V-shaped configuration or may extend downwardly outwardly from the top toward the bottom, requiring an elongated mounting base. The main requirement is that these upstanding arms provide a pair of spaced flexible members on which the wing struts are pivotally mounted, with the inner ends of the wing struts being located between the spaced flexible members and operatively engageable by the crank assembly. This provides a vertically reciprocating motion to the inner ends of the wing struts when the crank is rotated by the rubber band or other engine means.

Second Embodiment

Figure 9:
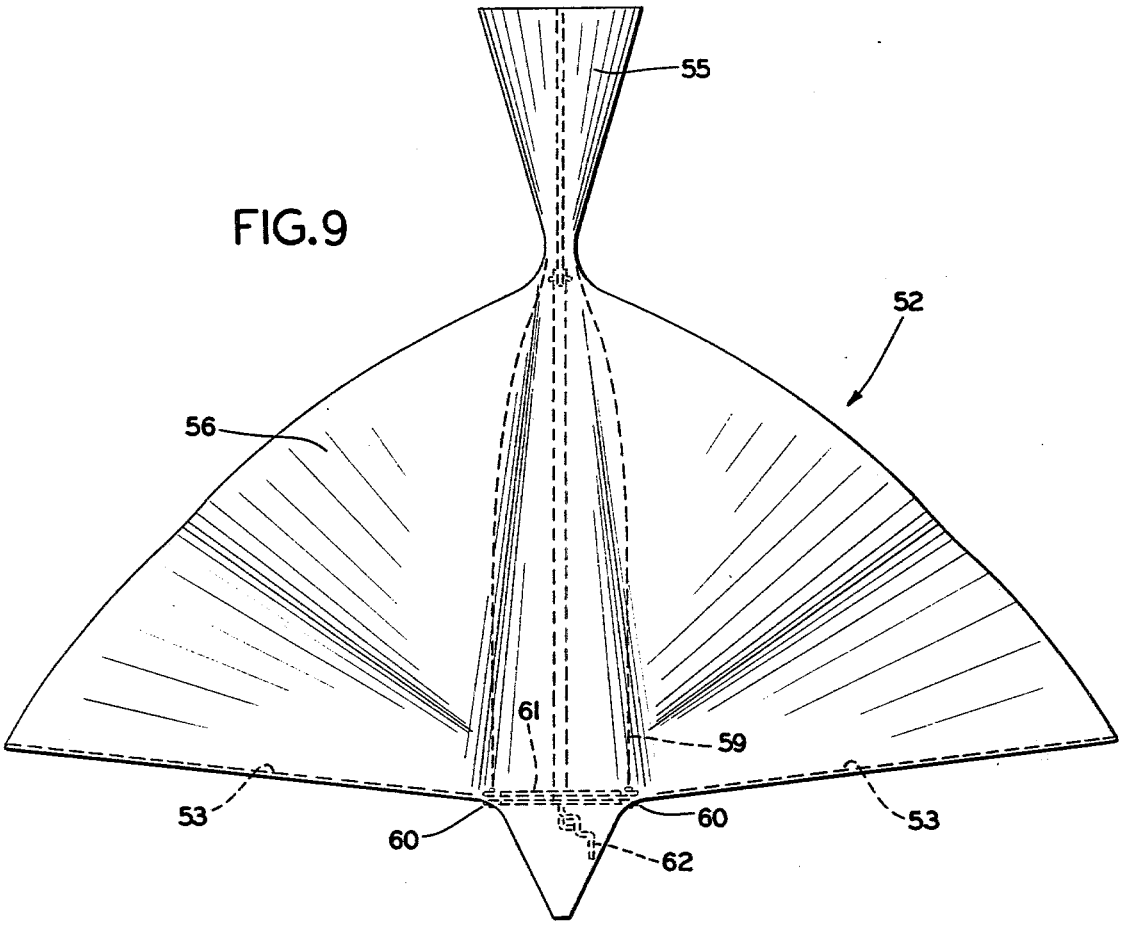
FIG. 9 is a somewhat diagrammatic top plan view similar to FIG. 1 showing a modified construction of the improved ornithopter.
Figure 10:
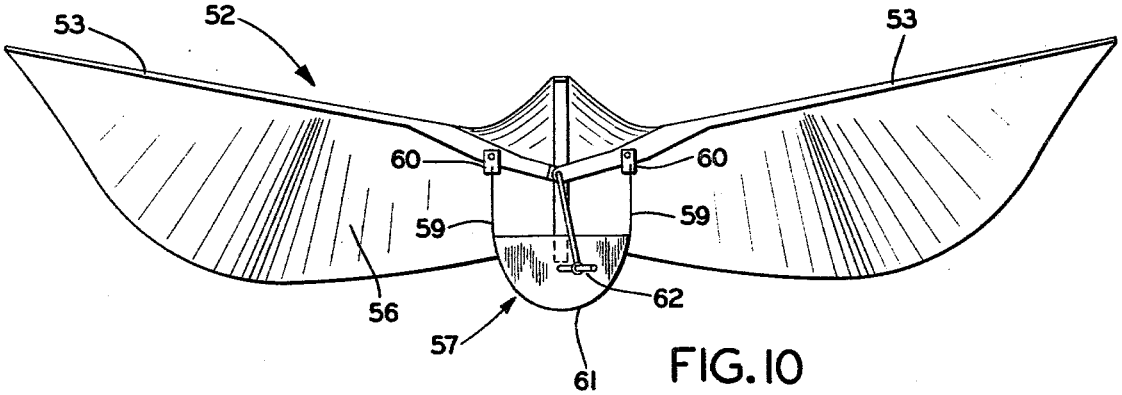
FIG. 10 is a front elevational view of the modified ornithopter construction shown in FIG. 9.
Figure 11:
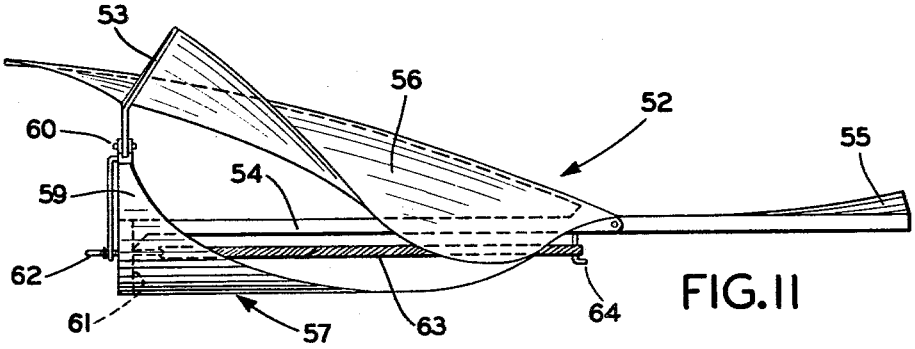
FIG. 11 is a right-hand side elevational view of the modified ornithopter construction of FIGS. 9 and 10.

A modified form of the improved ornithopter construction is shown in FIGS. 9, 10 and 11, and is indicated generally at 52. Modified ornithopter 52 is similar to ornithopter 1 in many respects in that it includes a pair of rigid wing struts 53, a rigid longitudinally extending base 54 which terminates in a rigid tail section 55, all of which are covered by a flexible material 56. Modified construction 52 is provided with a curved sheet of flexible material such as plastic or the like, indicated at 57. Sheet 57 is formed into a generally semicylindrical trough-like configuration having a pair of spaced upwardly extending front members 59 which provide the flexible arms similar to arms 16 of construction 1. A pivot block 60 is secured to the upper end of each member 59 for pivotally mounting wing struts 53 thereon. A semicircular crank mounting block 61 is mounted in the bottom of the trough-like formation formed by curved sheet 57 for rotatably mounting and supporting a crank 62. A rubber band 63 extends between and is connected to the inner end of crank 62 and a hook 64. Rubber band 63 extends along and beneath base 54 within the trough formed by sheet 57.

The operation and other features of modified ornithopter 52 are similar to those of ornithopter 1 and accordingly are not described in detail. This modified ornithopter construction merely illustrates one of the various arrangements that can be used to provide the spaced flexible front frame member for pivotally mounting the wing struts, in order to provide the flexing movement to enable the simultaneous uniform flapping wing movement.

Accordingly, the improved ornithopter is a very simple construction which provides an efficient and sturdy aircraft which obtains a symmetrical flapping motion of the wings to enable a smooth and sustained flight pattern to be achieved with a relatively small number of components, which components are relatively maintenance free; and in which the ornithopter provides a construction which is inexpensive to construct, relatively lightweight, which eliminates difficulties heretofore encountered with prior ornithopter constructions, which achieves the stated objectives, and which solves problems and satisfies needs existing in the art.

In the foregoing description, certain terms have been used for brevity, clearness and understanding but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved ornithopter construction is constructed, assembled and operated, the characteristics of the new construction, and the advantageous, new and useful results obtained; the new and useful structures, devices, elements, arrangements, parts, and combinations are set forth in the appended claims.

I claim:

1. An ornithopter construction including:

(a) a longitudinally extending base having front and rear ends;

(b) a flexible spline mounted on the base adjacent the rear end thereof and projecting upwardly forwardly toward the front end of the base and spaced generally vertically above said base;

(c) a generally U-shaped flexible member having a pair of upstanding spaced legs mounted on the front end of the base;

(d) a pair of wing struts extending transversely outwardly from adjacent the front end of the base, each of said struts having inner and outer ends;

(e) crank means rotatably mounted on the front end of the base;

(f) elastic motor means connected to the crank means for rotating said crank means;

(g) lever means operatively connected at one end to the crank means for generally reciprocating up and down movement upon rotation of said crank means, with another end of the lever means being operatively connected to the inner ends of the wing struts;

(h) flexible fabric means mounted on the wing struts and spline and extending generally between the front and rear ends of the base to form a pair of wings; and (i) the wing struts being pivotally mounted on the upstanding legs of the U-shaped flexible member adjacent the inner ends of the wing struts whereby reciprocating motion of the lever means upon rotation of the crank means by the elastic motor means pivots the wing struts on the legs providing a flapping motion to the wings simultaneously with an inward and outward flexing motion of the U-shaped member legs.

2. The ornithopter construction defined in claim 1 in which the fabric means biases the flexible spline downwardly toward the base.

3. The ornithopter construction defined in claim 1 in which the base includes a tail section pivotally mounted on the rear end of said base.

4. The ornithopter construction defined in claim 1 in which the spline extends forwardly beyond the transversely extending wing struts.

5. The ornithopter construction defined in claim 1 in which the elastic motor means is an elastic band which is mounted beneath and extends along the longitudinal base.

6. The ornithopter construction defined in claim 1 in which the base includes a tail section having a rigid member mounted on the rear end of the base and extending rearwardly therefrom; and in which a piece of flexible fabric is mounted on and extends outwardly from the rigid tail section member.

7. The ornithopter construction defined in claim 1 in which the inner end of the wing struts are in overlapping relationship between the spaced legs of the U-shaped flexible member; in which aligned openings are formed in the overlapped inner ends of the wing struts; and in which the other end of the lever means is pivotally mounted within said aligned openings.

8. An ornithopter construction including:

(a) longitudinally extending base means having front and rear ends;

(b) a pair of spaced flexible leg means mounted adjacent the front end of the base means;

(c) a pair of wing strut means pivotally mounted on the leg means and extending transversely outwardly with respect to the base means;

(d) crank means mounted on the base means and operatively connected to the strut means at respective locations inward of their connections with said leg means;

(e) motor means connected to the crank means for rotating said crank means;

(f) fabric means mounted on the wing strut means forming a pair of wings; and (g) the wing strut means being adapted to be pivotally moved in unison upon rotation of the crank means by the motor means together with an inward and outward flexing motion of the leg means to provide a uniform flapping motion to the wings.

9. The construction defined in claim 8 in which flexible spline means is mounted on the base means adjacent the rear end thereof and extends upwardly forwardly therefrom vertically above said base means.

10. The construction defined in claim 9 in which the fabric means is mounted on the spline means; and in which the spline means biases the fabric means upwardly to pivot the wing strut means toward upwardly extending positions.

11. The construction defined in claim 8 in which the wing strut means each have an inner end located between the spaced leg means; and in which lever means extends between and is operatively connected to the inner ends of the strut means and crank means for vertically oscillating said inner ends upon rotation of the crank means to pivotally move the strut means.

12. The construction defined in claim 8 in which the base means includes a movably mounted tail section.

13. The construction defined in claim 8 in which the spaced leg means is formed by a portion of a curved sheet of flexible plastic sheeting.

14. The construction defined in claim 8 in which the engine means is a strip of an elastic material.

15. The construction defined in claim 8 in which the leg means is formed by a pair of curved strips of flexible material forming a generally U-shaped configuration; and in which said strips are mounted on and extend upwardly from the front end of the base means.

* * * * *